US010043357B2

(12) United States Patent
Hartweg et al.

(10) Patent No.: US 10,043,357 B2
(45) Date of Patent: Aug. 7, 2018

(54) WEARABLES SECURITY DEVICE

(71) Applicant: InVue Security Products Inc., Charlotte, NC (US)

(72) Inventors: Robert O. Hartweg, Waxhaw, NC (US); Larry T. McKinney, Huntersville, NC (US)

(73) Assignee: InVue Security Products Inc., Charlotte, NC (US)

( * ) Notice: Subject to any disclaimer, the term of this patent is extended or adjusted under 35 U.S.C. 154(b) by 0 days.

(21) Appl. No.: 15/305,776

(22) PCT Filed: Apr. 28, 2015

(86) PCT No.: PCT/US2015/027878
§ 371 (c)(1),
(2) Date: Oct. 21, 2016

(87) PCT Pub. No.: WO2015/168052
PCT Pub. Date: Nov. 5, 2015

(65) Prior Publication Data

US 2017/0046931 A1 Feb. 16, 2017

Related U.S. Application Data

(60) Provisional application No. 61/984,971, filed on Apr. 28, 2014, provisional application No. 62/048,342, filed on Sep. 10, 2014.

(51) Int. Cl.

| | |
|---|---|
| ***G08B 13/14*** | (2006.01) |
| ***A47F 7/024*** | (2006.01) |
| ***A47F 7/02*** | (2006.01) |

(52) U.S. Cl.
CPC ..... *G08B 13/1463* (2013.01); *A47F 7/022* (2013.01); *A47F 7/024* (2013.01); *G08B 13/149* (2013.01)

(58) Field of Classification Search
None
See application file for complete search history.

(56) References Cited

U.S. PATENT DOCUMENTS 6,472,989 B2 10/2002 Roy
6,831,560 B2 * 12/2004 Gresset ..... A47F 7/024 340/568.2

(Continued)

FOREIGN PATENT DOCUMENTS

WO 2002/39856 A1 5/2002

OTHER PUBLICATIONS

PCT/US2015/027878, International Search Report and Written Opinion, dated Aug. 7, 2015 (11 pages).

(Continued)

*Primary Examiner* — Julie Lieu
(74) *Attorney, Agent, or Firm* — InVue Security Products Inc.

(57) ABSTRACT

A merchandise display security device for displaying and protecting a wearable device from theft is provided. In one example, the wearable device includes a body and a band secured thereto. The merchandise security device includes a sensor configured to be coupled to the wearable device between the body and the band. The sensor includes a sensing device configured to detect unauthorized removal of the body from the band.

18 Claims, 11 Drawing Sheets

(56) References Cited

U.S. PATENT DOCUMENTS

| | | | | |
|---|---|---|---|---|
| 8,368,536 | B2 | 2/2013 | Fawcett | |
| 8,584,845 | B2 | 11/2013 | Soltis, Jr. | |
| 2014/0347265 | A1* | 11/2014 | Aimone | G09G 3/003 345/156 |
| 2015/0332576 | A1* | 11/2015 | Son | G02C 11/10 340/686.6 |
| 2017/0086742 | A1* | 3/2017 | Harrison-Noonan | A61B 5/6843 |
| 2017/0098435 | A1* | 4/2017 | Inagaki | G09G 5/37 |
| 2017/0135449 | A1* | 5/2017 | Zhang | A44C 5/04 |

OTHER PUBLICATIONS

Wrist Watch Security Device, IP.com Publication No. IPCOM000238496D, Aug. 28, 2014 (17 pages).

* cited by examiner

WEARABLES SECURITY DEVICE

CROSS REFERENCE TO RELATED APPLICATIONS

This application claims the benefit to priority of U.S. Provisional Patent Application No. 61/984,971 filed on Apr. 28, 2014, and U.S. Provisional Patent Application No. 62/048,342 filed on Sep. 10, 2014, the entire disclosures of which are incorporated herein by reference.

FIELD OF THE INVENTION

Embodiments of the present invention relate generally to merchandise display security devices for displaying and protecting an article of merchandise from theft, such as a wearable device.

BACKGROUND OF THE INVENTION

Retailers routinely display articles of merchandise, such as cellular phones, portable computers (e.g. notebooks, laptops, tablets, etc.), e-readers, media players, and the like for customers to evaluate before making a purchase. These articles of merchandise are continually being made smaller and lighter in weight due to advances in technology and materials. As a result, such merchandise is increasingly vulnerable and susceptible to theft. Accordingly, these articles of merchandise need to be secured by a security device that effectively and cost efficiently protects the merchandise from theft.

"Smart" devices are beginning to propagate into the traditional watch and wearable computer ("wearables") space. It would be desirable for some retailers to protect such smart watches and wearables from theft, while providing suitable customer interaction with the watch.

Accordingly, there exists a need for an improved merchandise display security device for protecting wrist watches and wearables from theft. There exists a further need for a merchandise display security device that provides adequate security without hindering a customer's experience in a retail environment.

BRIEF SUMMARY

Embodiments of the present invention are directed to merchandise display security devices and methods for displaying and protecting an article of merchandise from theft. In one embodiment, the wearable device includes a body and a band secured thereto. The merchandise security device includes a sensor configured to be coupled to the wearable device between the body and the band. The sensor includes a sensing device configured to detect unauthorized removal of the body from the band.

In one aspect, a merchandise security device includes a wearable device comprising a body and a band secured thereto and a sensor configured to be coupled to the wearable device between the body and the band. The sensor includes a sensing device configured to detect unauthorized removal of the body from the band.

In another aspect, a method of displaying and protecting a wearable device from theft is provided. The method includes coupling a sensor to the wearable device between the body and the band, the sensor comprising a sensing device and arming the security device for detecting unauthorized removal of the body from the band with the sensing device.

In some cases, the article of merchandise is a wearable device comprising a body and a band secured thereto. In one embodiment, the security device includes a sensor configured to be coupled to the wearable device between the body and the band, wherein the sensor includes a cable. The cable is configured to define a sense loop therethrough when the sensor is coupled to the wearable device.

In another embodiment, a merchandise display security device includes a wearable device comprising a body and a band secured thereto and a sensor configured to be coupled to the wearable device between the body and the band. The sensor includes a cable configured to define a sense loop when the sensor is coupled to the wearable device.

In another embodiment, a method includes coupling a sensor to the wearable device between the body and the band, the sensor comprising a cable, and arming the security device such that a sense loop is defined through the cable when the sensor is coupled to the wearable device.

In another embodiment, a security device includes a sensor configured to be coupled to an article of merchandise. The sensor includes a sensing device configured to engage the article of merchandise when secured thereto and a switch assembly operably engaged with the sensing device. The switch assembly comprises a plurality of rotatable members disposed within a track, and the track extends between the sensing device and the switch. The switch is configured to be actuated in response to actuation of the sensing device.

DETAILED DESCRIPTION OF EMBODIMENTS OF THE INVENTION

Embodiments of the present invention will now be described more fully hereinafter with reference to the accompanying drawings, in which various embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

Figure 1:
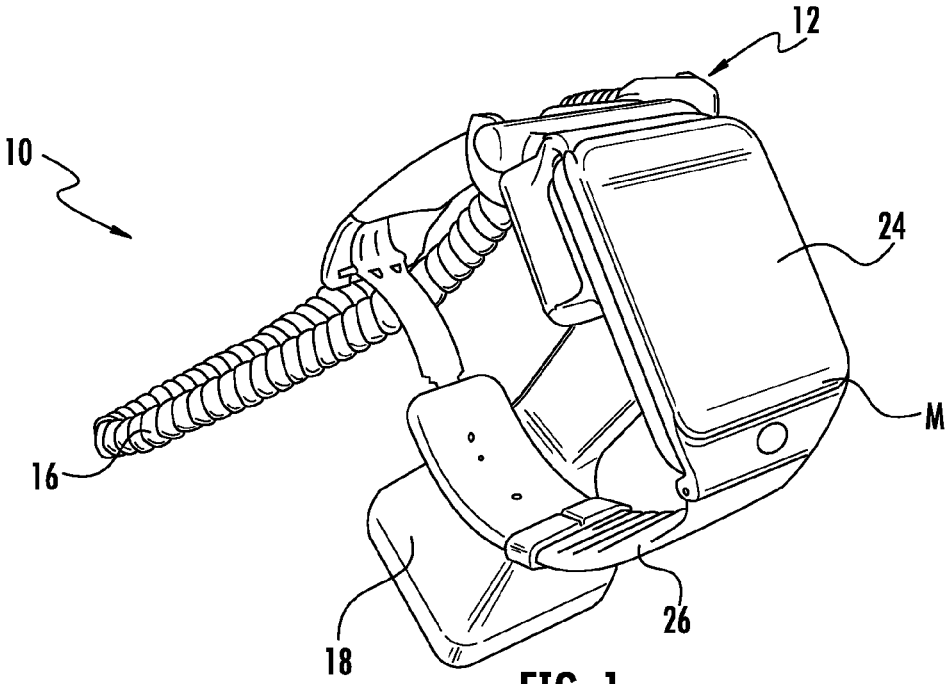
FIG. 1 is a perspective view of a merchandise display security device according to one embodiment of the present invention.
Figure 2:
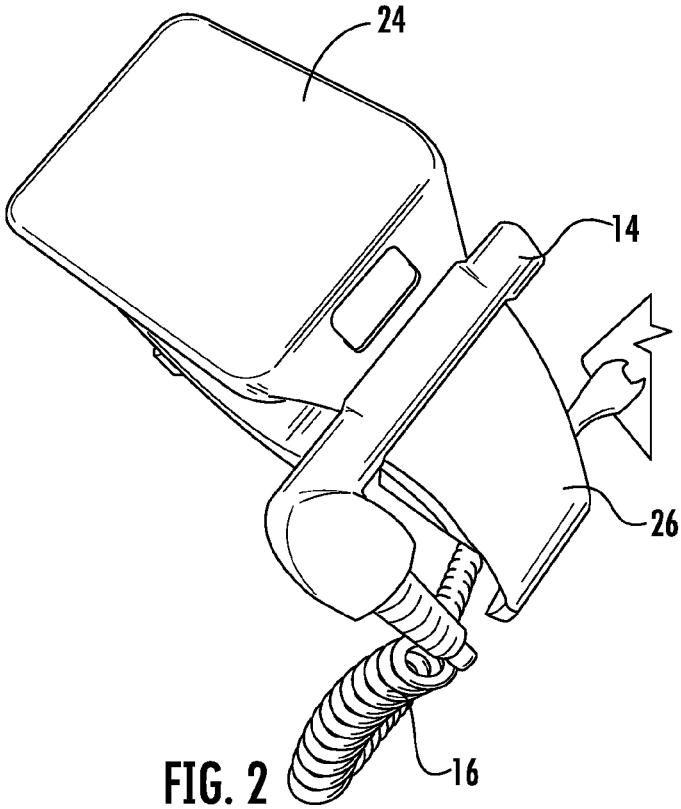
FIG. 2 is another perspective view of the merchandise display security device shown in FIG. 1.

Referring now to the accompanying drawing figures wherein like reference numerals denote like elements throughout the various views, one or more embodiments of a merchandise display security device for displaying and protecting an article of merchandise from theft are shown. More particularly, the drawing figures show embodiments of a merchandise display security device, indicated generally by reference character 10, for being attached to an article of merchandise, indicated generally by reference character M. In one embodiment, the article of merchandise is a wrist watch or wearable computer having a band and a body (collectively "wearable devices"). The body may include any number of components, such as an internal battery, processor, wireless communication circuitry, etc. The article of merchandise may be a smartwatch in some embodiments. A smartwatch may be like a wrist watch in some respects but include additional functionality, such as similar functionality provided by a computer, mobile phone, or personal digital assistant. In other embodiments, the article of merchandise is any device configured to be secured about a wearer's wrist or otherwise worn by a consumer (e.g., about a consumer's wrist, ankle, neck, etc.). For example, the article of merchandise may be any "wearable" device (e.g., the Samsung Gear Fit, the Samsung Galaxy Gear, or the Samsung Gear 2 (see e.g., FIG. 1).

In one embodiment, the security device 10 includes a sensor 12 coupled to the article of merchandise M. In the embodiment shown in FIGS. 1-4, the security device 10 comprises a sensor body 14 and a cable 16 coupled thereto. The sensor body 14 may be configured to be secured to the article of merchandise M for protecting the article from theft or unauthorized removal, as explained in further detail below. The sensor 12 may be adaptable for use with a variety of wearable devices such that the illustrated embodiments are not intended to be limiting.

Figure 14:
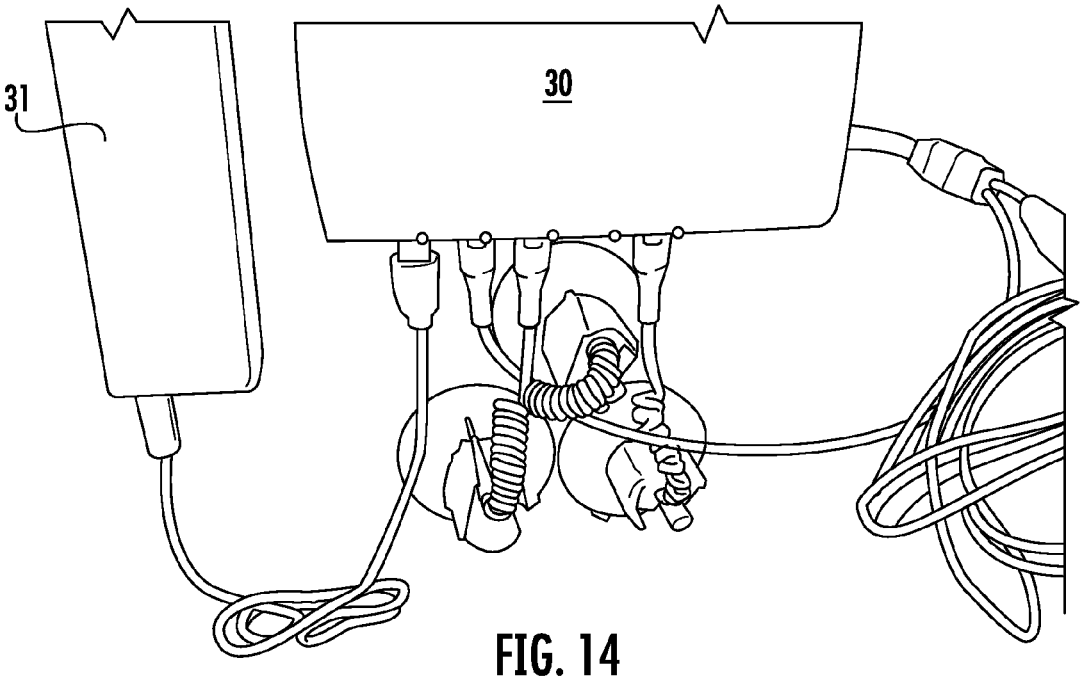
FIG. 14 is a schematic of an alarm module and a power source according to one embodiment of the invention.
Figure 15:
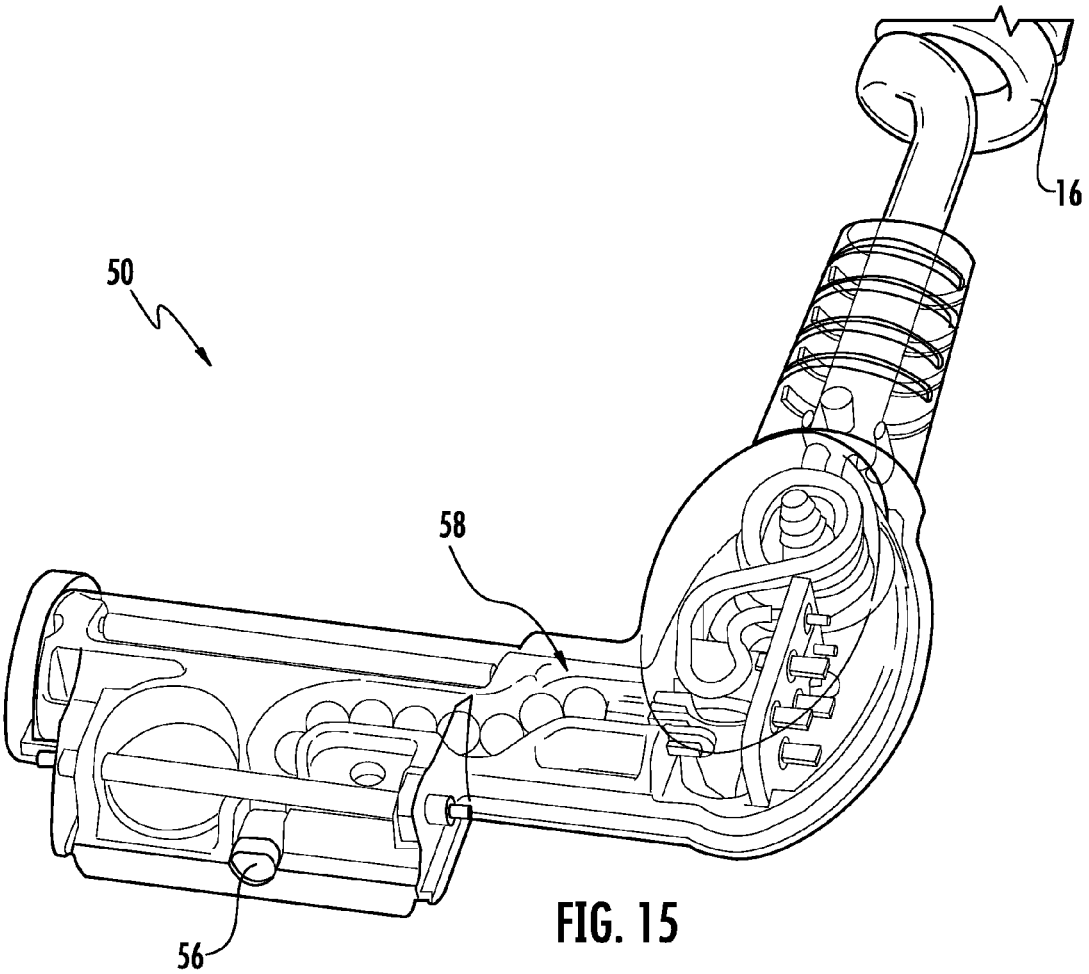
FIG. 15 is a perspective view of a sensor according to one embodiment of the present invention.
Figure 16:
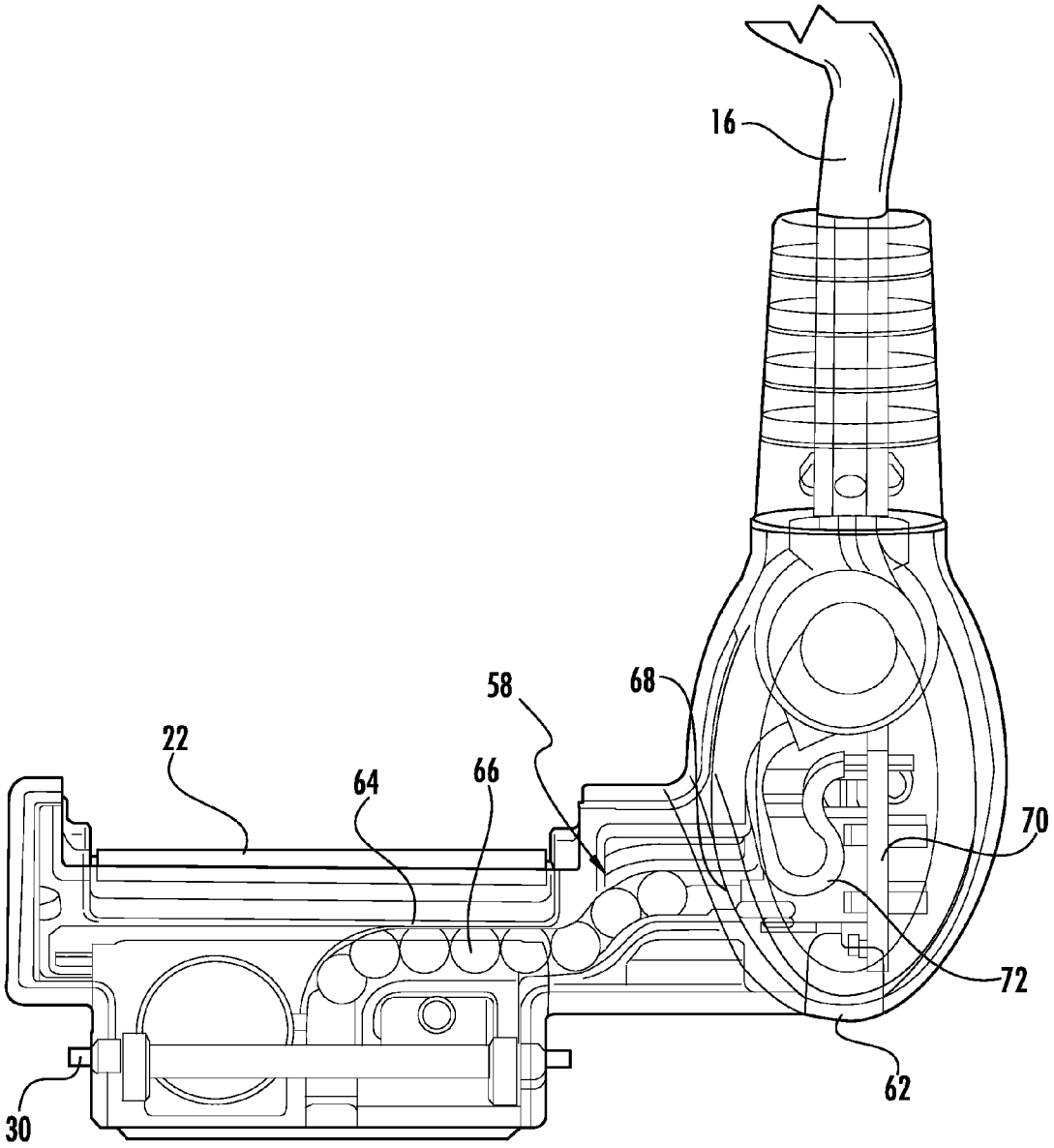
FIG. 16 is an elevation view of the sensor shown in FIG. 15.
Figure 17:
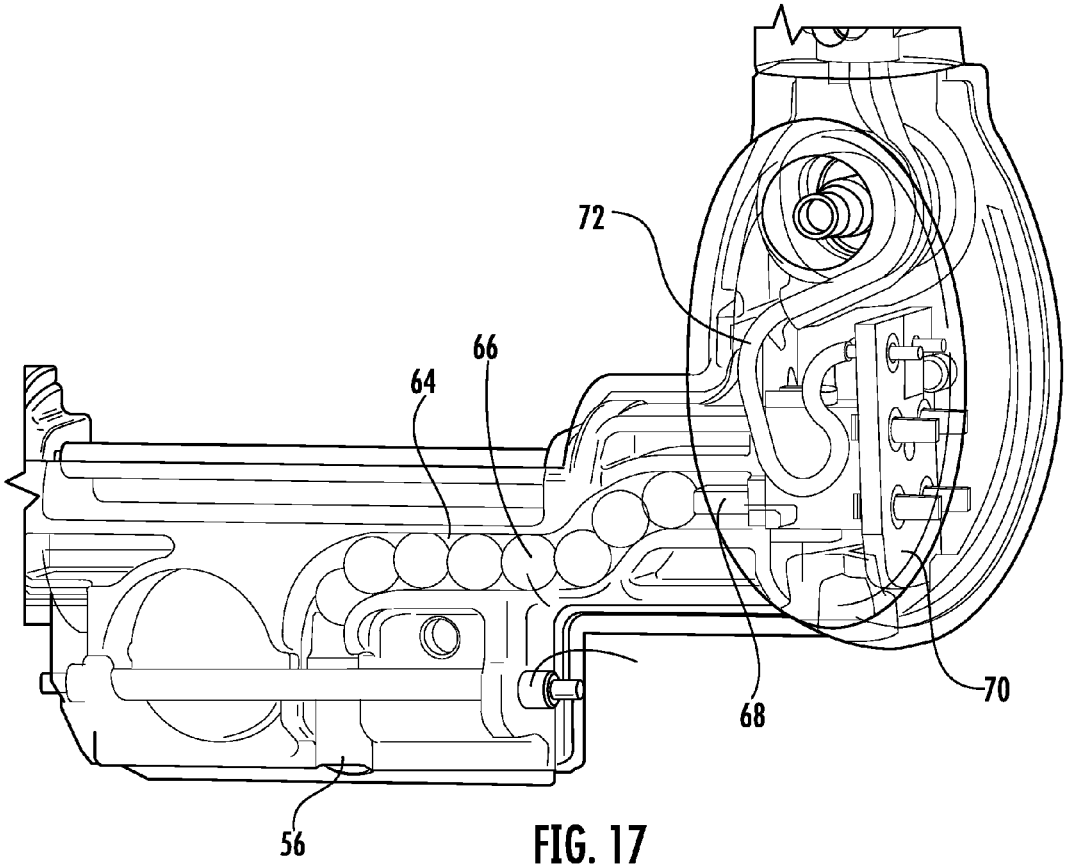
FIG. 17 is an enlarged elevation view of the sensor shown in FIG. 15.

Cable 16 may be configured to electrically connect the article of merchandise M to an alarm module 30 and to activate an audible and/or a visible alarm in the event that the cable is cut, severed, or removed from the article of merchandise M and/or sensor 12, or should the article of merchandise be removed from the sensor (see, e.g., FIG. 14). As such, cable 16 may comprise one or more conductors disposed within a protective outer sheath. At least one of the conductors may conduct a security signal between the sensor 12 and the alarm module 30, which is configured to activate an alarm in the event that the electrical signal or sense loop is interrupted in one of the aforementioned manners indicating a possible theft condition. The alarm module 30 may be configured to be armed or disarmed with a key, such as an electronic key configured to wirelessly transmit a security code. A plug or other connector, for example a USB connector, may be disposed at one end of the cable 16 for electrically connecting the cable to the alarm module 30, which may be in turn connected to an external source of electrical power 31, for example a conventional 110V AC power outlet. The other end of the cable 16 may be connected to the sensor 12 via hardwiring or a connector for electrically connecting the cable to the sensor and any associated sensor electronics.

As will be understood and appreciated, cable 16 alternatively may be a mechanical security cable, for example a high strength, cut resistant cable, with or without a security signal conductor in the event that the displayed article of merchandise M does not require electrical power or obtains electrical power from another power cable. Likewise, the cable 16 may alternatively be a power cable that provides electrical power to the electronic article of merchandise M without a security signal conductor in the event that the mechanical security provided by the electro-mechanical power cable is sufficient for protecting the article of merchandise from theft.

In the embodiment of the security device 10 illustrated in FIG. 14, the alarm module 30 is shown positioned in a secure location, for example underneath a display counter or within a locked cabinet, so that the alarm module is not readily accessible to unauthorized persons. The alarm module 30 is configured to contain alarm electronics for monitoring the state of the security signal conducted by the cable 16 and for activating an internal or remote audible and/or visible alarm in the event of a possible theft condition. The alarm module 30 may optionally contain voltage regulating and/or power management electronics for modulating the voltage (e.g. 18V) of the external source of electrical power to provide an appropriate operating voltage (e.g. 5V) to the article of merchandise.

Figure 18:
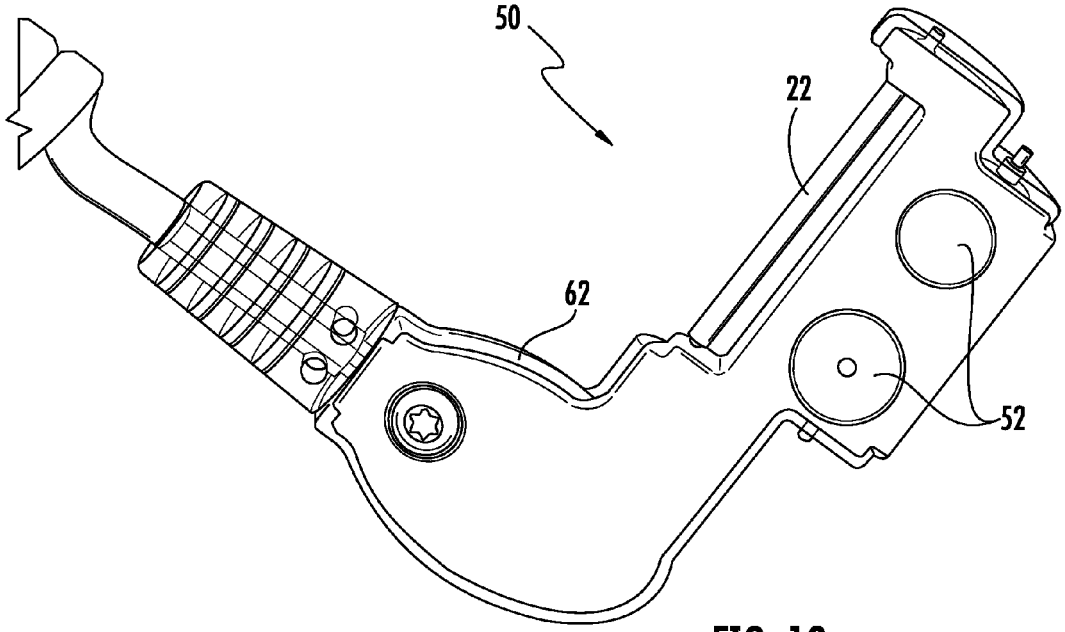
FIG. 18 is bottom elevation view of the sensor shown in FIG. 15.

As shown FIGS. 1, 5, 6, 10, and 13, the security device 10 may include a display stand 18 for supporting the article of merchandise, although such a display stand is not required in some embodiments. The display stand 18 may be in the form of a pedestal for supporting the article of merchandise M in a displayed position. The display stand 18 may be configured to be secured to a display surface, such as a counter, fixture, table, shelf, or the like, such as with a pressure-sensitive adhesive. The display stand 18 may include a support member 20 configured to support the article of merchandise M thereon. In one example, the support member 20 may be generally U-shaped (see, e.g., FIG. 6), and the sensor body 14 may include a corresponding cylindrical or curved surface for mating with the U-shape. The article of merchandise M may be readily removed from the display stand 18 for inspection. The cable 16 may extend between and be connected to both the sensor 12 and the display stand 18. The cable 16 could be releasably connected to the display stand 18 with a connector or could be hardwired thereto. A portion of the cable 16 may be elastically extendable and retractable such that the article of merchandise M attached thereto may be extended away from the display stand 18 for inspection. In addition, the display stand 18 could include an alignment mechanism for cooperating with the sensor 12 coupled to the article of merchandise M for securing the article in a desired position. For example, the display stand 18 could include one or more magnets or magnetically attractable material configured to cooperate with corresponding magnets or magnetically attractable material on the sensor 12 and/or the article of merchandise M. In some cases, the display stand 18 and sensor may include a pair of magnets of opposite polarity for facilitating proper placement of the sensor 12 on the display stand. For example, FIG. 18 shows a sensor 50 including a pair of magnets 52, wherein each magnet may have a different polarity. The display stand 18 may include a similar pair of magnets such that the sensor 12 may be positioned so that the magnets attract to one another while preventing the sensor from being positioned in an incorrect display position due to the polarity of the magnets.

The display stand 18 may also include electronics (e.g., circuitry or a printed circuit board) for electrically connecting the alarm module 30 and the sensor 12. The electronics in the display stand 18 could also be employed to pass power to the article of merchandise M when supported thereon. The alarm module 30 may be configured to generate an alarm should the cable 16 be removed from the display stand 18. It is understood that the display stand 18 may be electrically connected to a remote alarm module 30, or the alarm module may be integrated with the display stand. Thus, the alarming electronics may be integrated within the display stand 18 if desired for providing a standalone security solution. It is further understood that the size and configuration of the display stand 18 may be modified to accommodate any desired wearable device, as well as sensors 12 having different sizes and configurations.

Figure 5:
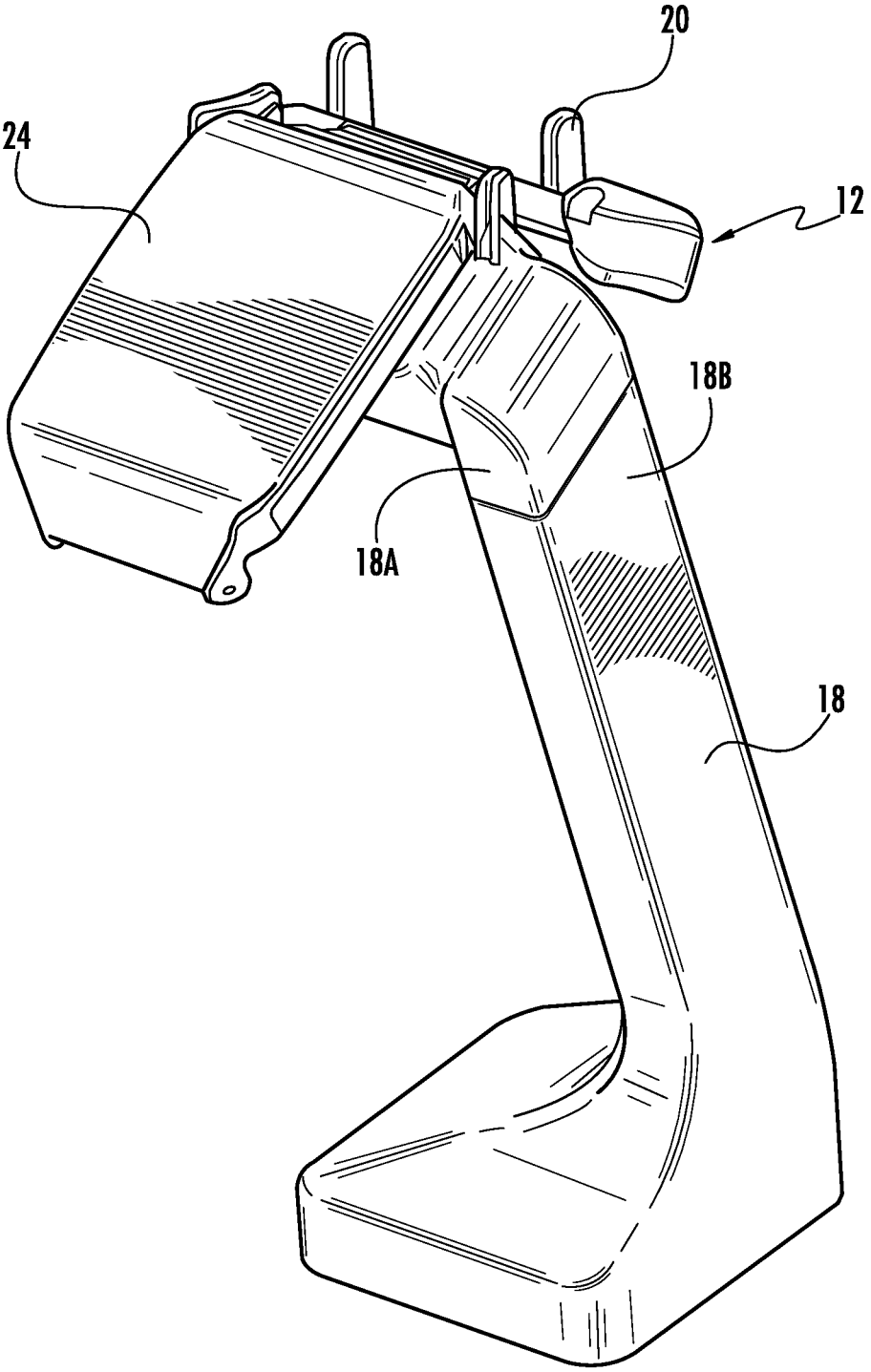
FIG. 5 is a perspective view of a merchandise display security device according to another embodiment of the present invention.
Figure 6:
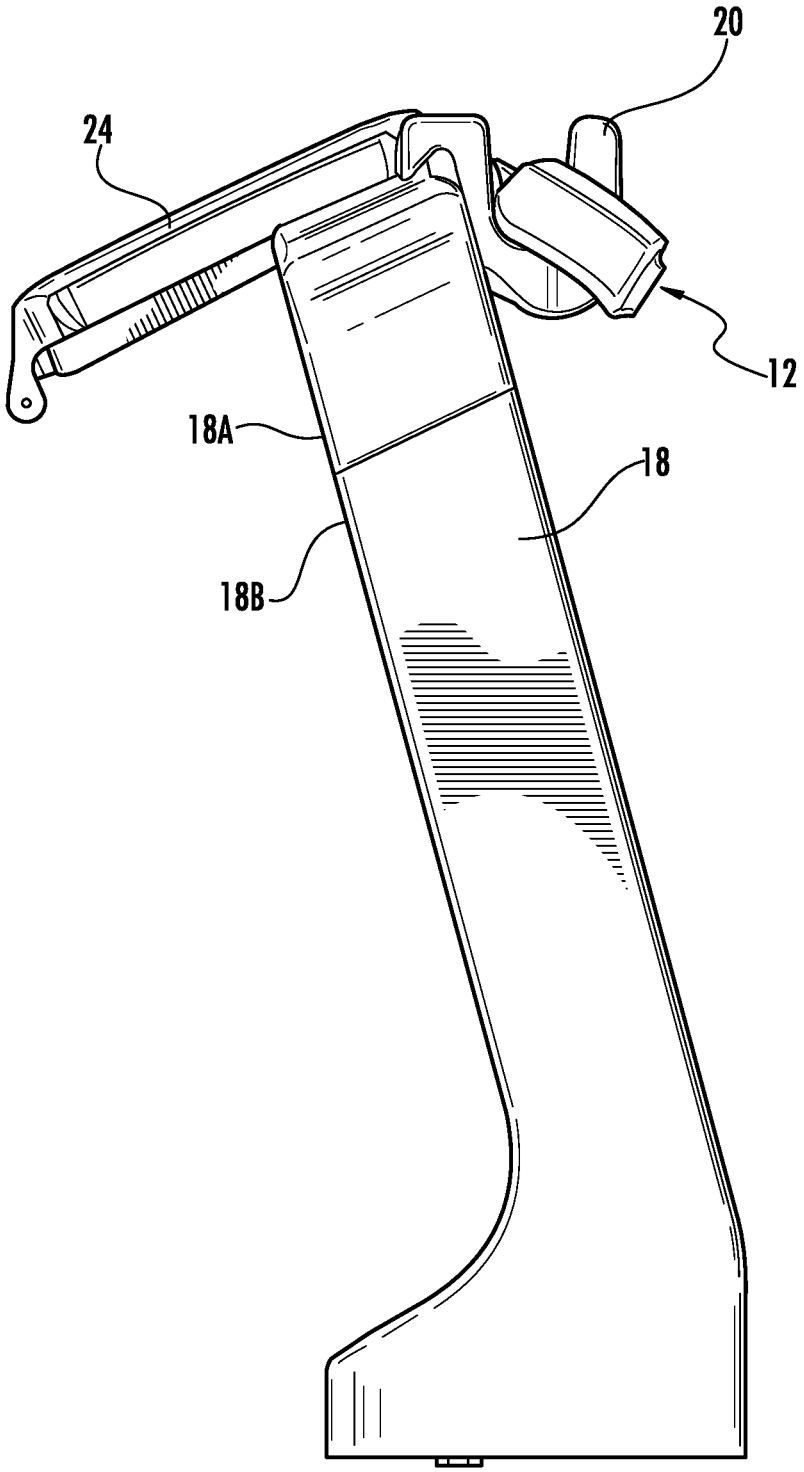
FIG. 6 is a side view of the merchandise display security device shown in FIG. 5.
Figure 7:
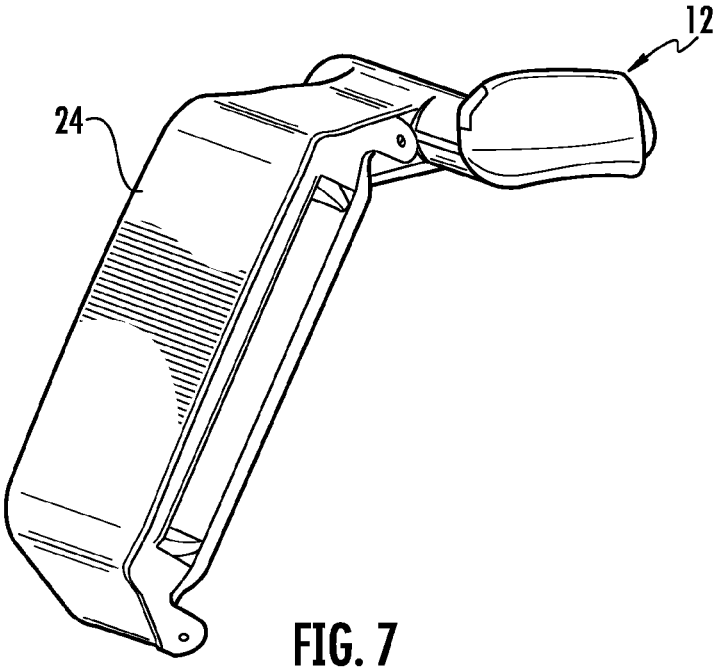
FIG. 7 is a perspective view of a watch body and a sensor of the merchandise display security device shown in FIG. 5.

In one embodiment shown in FIGS. 5-6, the display stand 18 may comprise a modular assembly, such as a detachable head 18A and a stand 18B. The head 18A and stand 18B may be configured to detachably connect to one another. When connected, the head 18A and stand 18B may be in electrical communication with one another. In order to facilitate an electrical connection between the head 18A and the stand 18B, the head and stand may each include a suitable releasable connector for electrically connecting to one another (e.g., a micro-USB connector). In this embodiment, the stand 18B may be configured to receive and electrically connect to one of a plurality of different heads 18A. For example, different heads 18A may be used for accommodating different types of wearable devices, such as to accommodate a different size and shape of the wearable device and the associated sensor 12, as well as different locations of contacts 38, 40 for charging the wearable device. As such, the display stand 18 may allow for modularity between different types of heads 18A with a common stand 18B. In some cases, a fastener or the like may be employed to secure the head 18A to the stand 18B.

Figure 3:
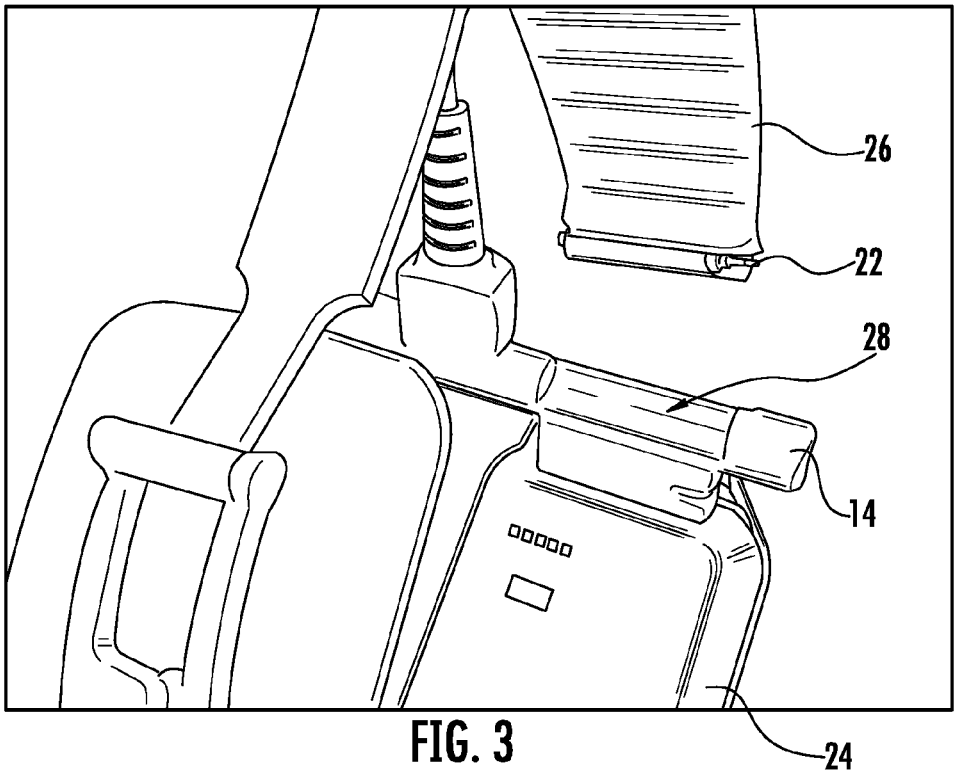
FIG. 3 is an enlarged perspective view of a band detached from a sensor of the merchandise display security device shown in FIG. 1.
Figure 4:
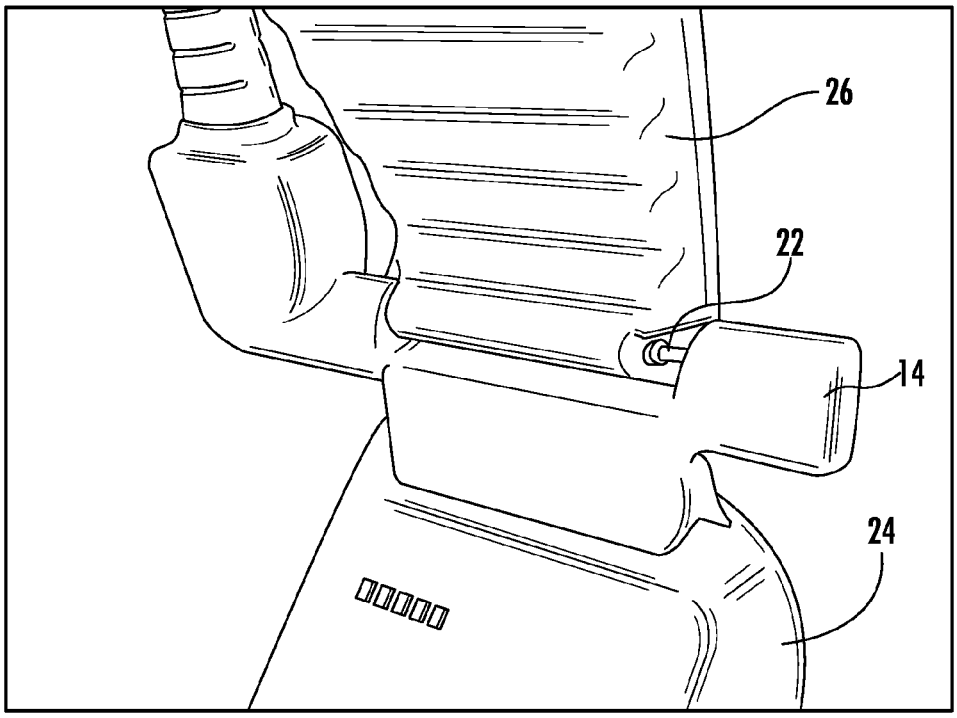
FIG. 4 is an enlarged perspective view of the band attached to the sensor shown in FIG. 3.

In one embodiment, the cable 16 terminates with a sensor 12 that is configured to attach to the article of merchandise M, such as a wrist watch or other wearable device. FIGS. 1-9 show embodiments of a security device configured for use with a wrist watch, while FIGS. 10-13 show embodiments of a security device for use with a wearable device (note that the band has been omitted in FIGS. 5-8, 10, and 11 for purposes of clarity). In the illustrated embodiments, the wearable device may include a body 24 configured to be secured to a band 26, wherein the band is configured to be secured to a wearer's wrist. With reference to FIGS. 3 and 4, the wearable device may include a pin 22 that is configured to connect the body 24 to the band 26. Such pin 22 may be the same pin used to connect the body to the band during typical use. The sensor body 14 includes an opening 28 configured to receive an end of the band. The sensor body 14 may include a pair of pin openings 29 for receiving respective ends of the pin 22 to secure the end of the band 26 to the sensor body 14 within the opening 28 (see, e.g., FIG. 9).

Figure 9:
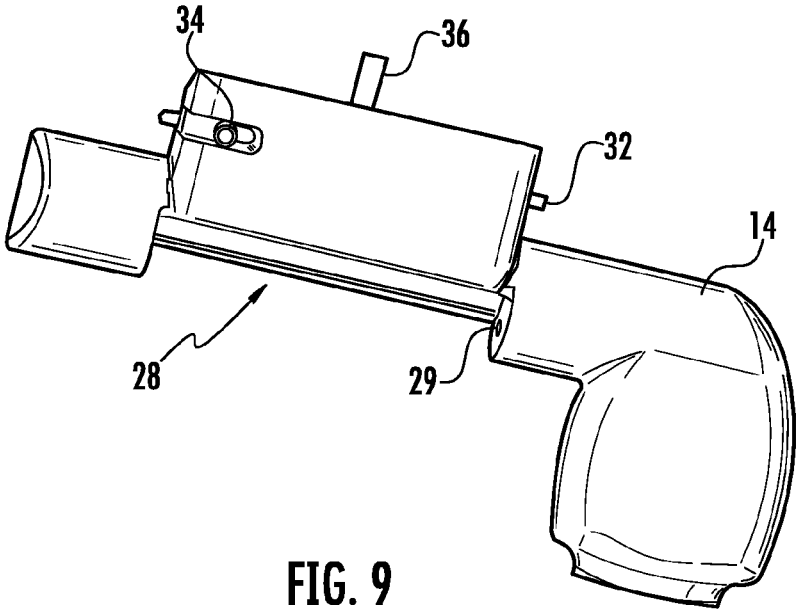
FIG. 9 is a perspective view of the sensor of the merchandise display security device shown in FIG. 5.

Moreover, the sensor body 14 may further include an engagement member 32 configured to couple the body 24 to the band 26 (see, e.g., FIG. 9). As shown in FIG. 4, the sensor body 14 may be configured to be positioned between the body 24 and the band 26. A portion of the sensor body 14 may engage both the body 24 and the band 26, at least across a width of the body and the band. In the embodiment shown in FIG. 2, the body 24 and the band 26 are secured together via the sensor body 14. Thus, the sensor body 14 may function as an "engagement member" while also providing security. The engagement member 32 may be a pin, fastener, or the like that is configured to engage the body 24. For example, the engagement member 32 could be configured to engage the pin openings defined in the body 24 that are configured to receive the pin 22. The engagement member 32 may be a proprietary fastener in some embodiments. Thus, the sensor body 14 may define a through opening that is configured to receive the engagement member 32. In one embodiment, the sensor 12 may also include a release mechanism 34 (see, e.g., FIG. 9). The release mechanism 34 may be used to disengage the engagement member 32 from the body 24.

Figure 10:
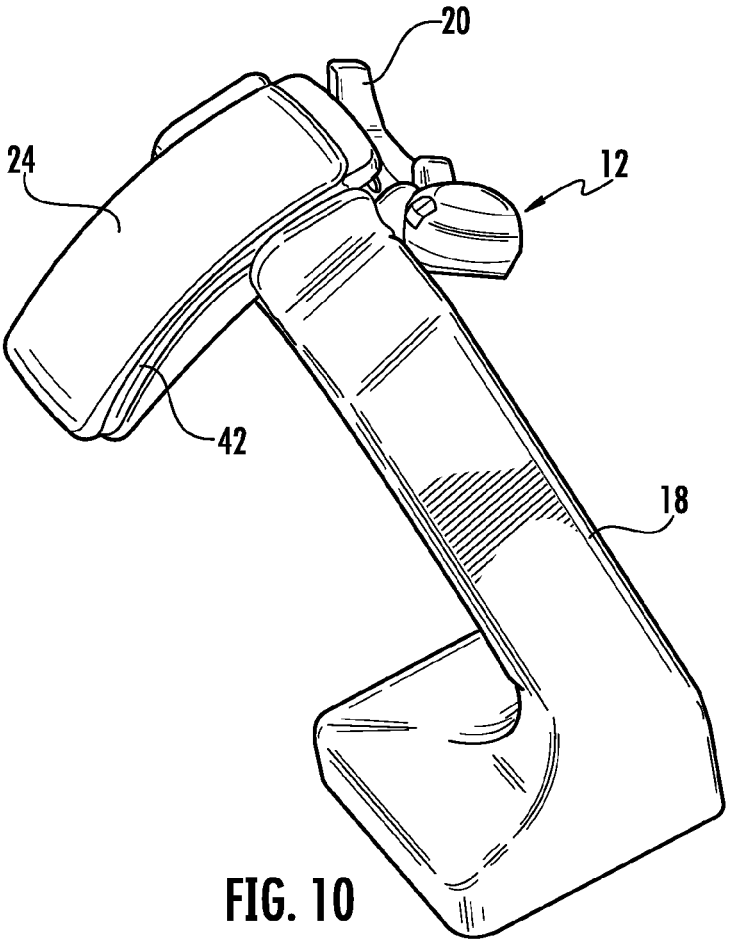
FIG. 10 is a perspective view of a merchandise display security device according to another embodiment of the present invention.

In an alternative embodiment, the body 24 of the wearable device includes a groove 42 that is configured to engage the band 26 (see, e.g., FIG. 10). A slot 42 may be defined in opposite sides of the body 24 for receiving a portion of the band 26 therein or about the entire perimeter of the body. In addition, the band 26 may define an opening for receiving and surrounding the perimeter of the body. Thus, the band 26 and body 24 may be secured together without one or more pins 22. In this case, the band 26 may comprise an elastic material that is configured to engage the body 24. A portion of the band 26 may be configured to be inserted within the grove 42. The band 26 may also be configured to engage the sensor body 14. In this regard, the sensor body 14 may also define a groove 44 for receiving a portion of the band 26 therein that aligns with the groove 42 defined in the body of the wearable device (see, e.g., FIG. 11). The band 26 may have an elasticity that enables the band to be stretched over a portion of the sensor body 14 so that the sensor body is disposed between the body 24 and the band. When in a relaxed state, the elasticity of the band 26 urges the sensor 12 into a firm engagement with the body 24 and within the grooves 42, 44. When the band 26 is engaged with the sensor body 14 and the body 24 of the wearable device, a sensing device may be engaged with the body of the wearable device. Therefore, the sensor 12 is secured to the wearable device when the band 26 is secured to the sensor body 14. In some instances, should the band 26 be removed, the body 24 may disengage the sensing device, which may result in generation of an alarm.

Thus, the sensor 12 may include a sensing device 36 configured to detect removal of the body 24 in an unauthorized manner (see, e.g., FIG. 9). For example, the sensing device 36 may be a pressure or plunger switch that is configured to engage the watch body 24 when the sensor 12 is secured thereto. The sensing device 36 may be in communication with sensor electronics in the sensor 12 that is configured to detect actuation of the sensing device to thereby provide a signal to the alarm module 30 via the cable 16 for generating an alarm. Thus, the sensor electronics may be in electrical communication with the alarm module 30 and associated alarm electronics via the cable 16. In some embodiments, the sensor electronics includes circuitry, a printed circuit board, or the like that is electrically connected to the sensing device 36 and the cable 16. Engagement of the sensing device 36 with the body 24 may cause the sense loop to be completed and the alarm module 30 to be armed. Alternatively, a key may be used to arm the sensing device 36.

Figure 8:
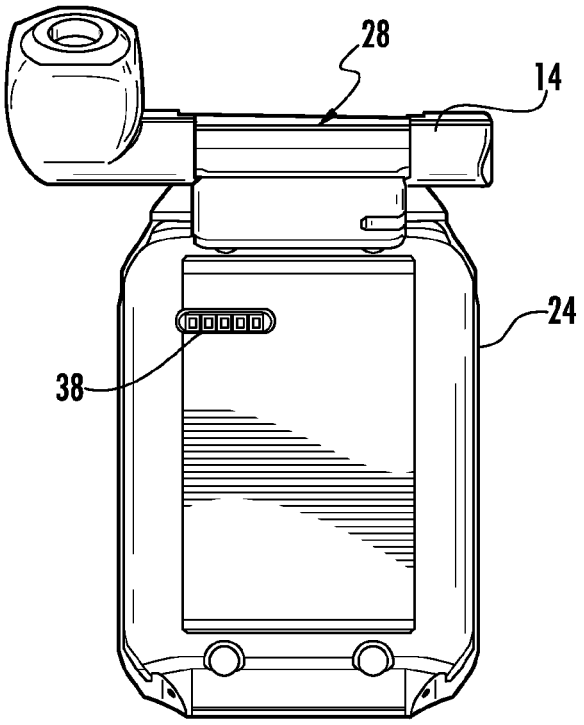
FIG. 8 is a rear view of the watch body and the sensor shown in FIG. 7.
Figure 11:
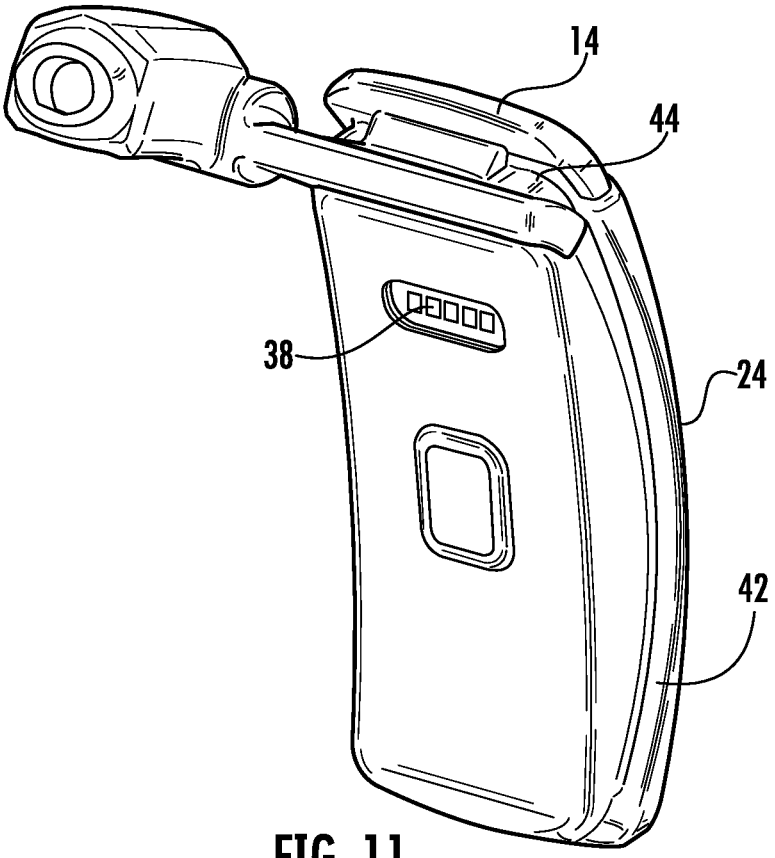
FIG. 11 is a rear perspective view of a watch body and a sensor of the merchandise display security device shown in FIG. 10.
Figure 12:
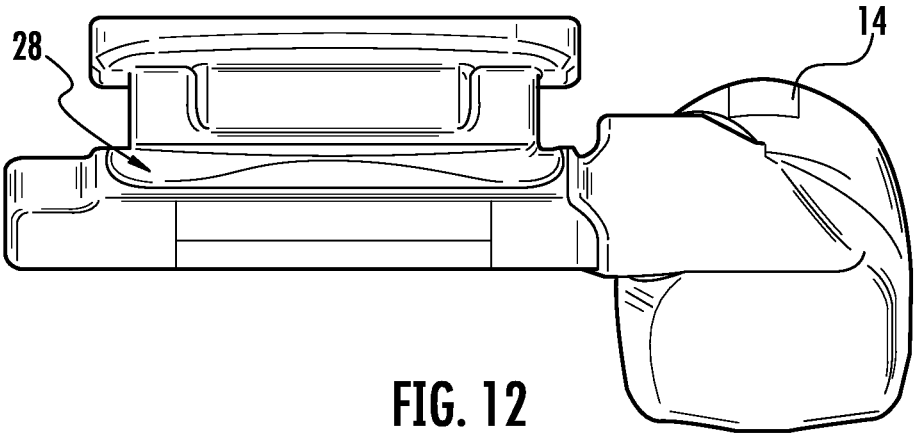
FIG. 12 is an end view of the watch body and the sensor shown in FIG. 11.
Figure 13:
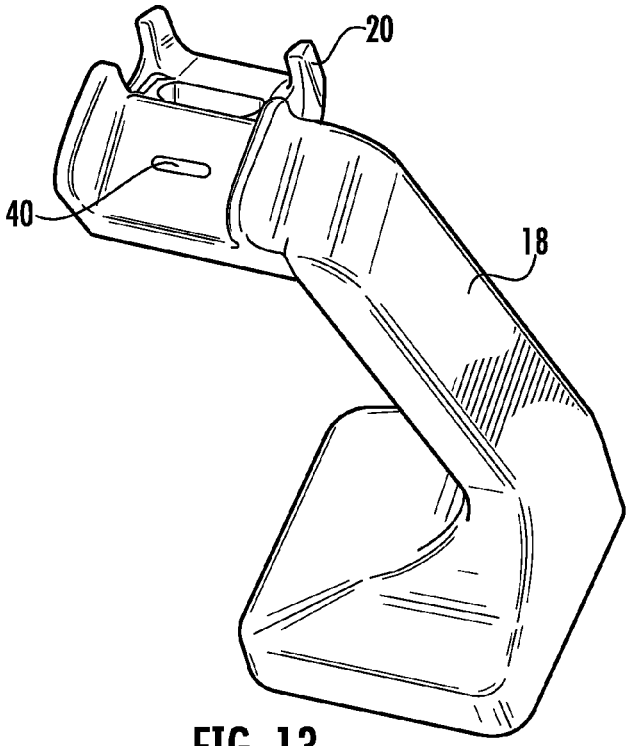
FIG. 13 is a perspective view of a stand of the merchandise security device shown in FIG. 10.

FIGS. 8 and 11 illustrate that the wearable device may include one or more contacts 38 on a rear surface thereof. The contacts 38 may be utilized for powering the wearable device or charging an internal battery. The display stand 18 may include an interface for establishing electrical communication with the contacts 38. For example, the wearable device may include a plurality of contacts 38 on its interior surface for coupling with one or more contacts 40 associated with the display stand to facilitate electrical contact (see, e.g., FIG. 13). The contacts 38, 40 may be formed of electrically conductive material. In some embodiments, the contacts 40 on the display stand 18 are flexible (e.g., "pogo pins") and are configured to flex relative to the contacts 38 on the wearable device for facilitating electrical communication therebetween. The electrical connection may be used for charging the internal battery of the wearable device. As such, a plug connection (e.g., USB or micro-USB) is not required between the interfaces in order to establish electrical communication, as only direct electrical contact between the contracts 38, 40 are required in this embodiment. In the instance where power is desired to be provided to the wearable device, the display stand 18 may be electrically connected to a power source 31 via a power cable. Thus, the security device 10 may permit a potential purchaser to examine and operate the wearable device in a powered state while secured. It is understood that a variety of techniques may be used to provide power to the wearable device, such as electrical contacts as discussed above, inductance, and an adapter cable (sometimes referred to as a "pigtail") electrically connected to the sensor 12 and having a connector for engaging an input port on the wearable device (e.g., a micro-USB, USB-A, or USB-C connector). Moreover, in some instances, the display stand may not be electrically connected to cable 16, and the cable 16 can be electrically connected to an alarm module 30 for providing power and/or security signals. In this case, the display stand 18 can be a "dummy" stand and not contain any electronics.

Notably, the sensor 12 is located at one end of the wearable device. The sensor body 14 is also positioned between the body 24 and the band 26 (e.g., at least across a width of the body and the band). As a result, the customer is able to model the wearable device on his or her wrist without interference of the sensor 12. For example, the sensor 12 may be sized and configured so as not hinder a customer's ability to wear the wearable device. The sensor 12 also does not require clamps or other features that surround the body 24 of the wearable device or that are visible and take away from the display of the wearable device. In some embodiments, the band 26 of the wearable device may not be secured other than via engagement with the sensor 12 and/or the body 24 such that an alarm will not sound if the band is removed from the sensor and/or wearable device or otherwise tampered with. However, a secondary sensor could be used to protect the band if desired. Alternatively, the band 26 may remain unsecured where it is known that the body 24 is the more valuable component of the wearable device.

FIGS. 15-18 show another embodiment of a sensor 50. In this embodiment, the sensor 50 includes a sensing device 56 (e.g., a plunger switch) similar to that described above that is configured to engage the watch body 24. In this embodiment, the sensor 50 includes a switch assembly 58 that is configured to actuate a switch assembly 58 within the sensor housing 62. The switch assembly 58 includes a track 64 configured to receive and guide a plurality of rotatable members 66 (e.g., balls or spheres). The switch assembly 58 also includes a switch 60. The track 64 may extend between the sensing device 56 and a switch 68. The track 64 may be various shapes, such as serpentine or curvilinear, and may be three-dimensional in some embodiments. Thus, the rotatable members 66 may be configured to move within a plane and/or change elevation as the rotatable members travel through the track 64. Likewise, the rotatable members 66 may be any number and a variety of shapes and configurations for conforming to the shape and configuration of the track 64. The switch 60 may be electrically connected to a printed circuit board 70, circuitry, or the like that is in turn electrically connected to the cable 16, such as via one or more conductors 72.

The rotatable members 66 may be configured to move within the track 64 in response to actuation of the sensing device 56 and/or the switch 68. For instance, the switch 68 could be biased towards the rotatable members 66 for urging the rotatable members towards the sensing device 56 for extending the sensing device outwardly from the sensor housing 62. In some cases, a biasing member (e.g., a spring) could be disposed within the switch 68 or between the switch and rotatable members 66 for urging the rotatable members towards the sensing device 56. In one embodiment, actuation of the sensing device 56 results in one-to-one movement of the switch 68. When the sensor 50 is engaged with a watch body, the sensing device 56 is urged to a retracted position thereby urging the rotatable members 66 towards the switch 68 for actuating the switch to a closed state and forming a sense loop. Thus, the switch 68 may be actuated in response to the sensing device 56 being actuated despite no electrical connection therebetween. Likewise, the sensing device 56 may be a mechanical switch such that no electrical connection is required between the sensing device and the switch 68. Should the watch body 24 be removed by an unauthorized person or without disarming the alarm module 30, the sensing device 56 will extend outwardly as a result of movement of the rotatable members 66 away from the switch 68 thereby causing the switch to be actuated to an open state and interruption of the sense loop. The open state may be detectable by the alarm module 30 and the alarm module may be configured to activate a security signal in response thereto.

The switch assembly 58 allows greater flexibility in the shape and configuration of the sensor 50 since the sensing device 56 and the switch 68 may be located remotely from one another and not require any electrical connection therebetween. In addition, the sensing device 56 may be located at any desired location and in any desired orientation where the switch assembly 58 is utilized. Furthermore, it is contemplated that the switch assembly 58 may be employed with any desired sensor for a variety of articles of merchandise. Thus, the aforementioned discussion of the sensor 50 configured for use with a watch or wearable device should not be limiting, as the sensor and associated switch assembly 58 may be used with any article of merchandise.

The foregoing has described one or more embodiments of a merchandise display for displaying and protecting an article of merchandise such as a wrist watch or wearable. Those of ordinary skill in the art will understand and appreciate that numerous variations and modifications of the invention may be made without departing from the spirit and scope of the invention. Accordingly, all such variations and modifications are intended to be encompassed by the appended claims.

That which is claimed is:

1. A merchandise display security device for displaying and protecting a wearable device from theft, the wearable device comprising a body and a band secured thereto, the security device comprising:

a sensor configured to be coupled to the wearable device between the body and the band such that the sensor is configured to attach the body to the band, the sensor comprising a sensing device configured to detect unauthorized removal of the body from the sensor.

2. The security device of claim 1, wherein the sensing device is configured to engage the body when secured thereto.

3. The security device of claim 2, wherein the sensor further comprises a switch assembly operably engaged with the sensing device.

4. The security device of claim 3, wherein the switch assembly comprises a plurality of rotatable members disposed within a track, and wherein the track extends between the sensing device and the switch.

5. The security device of claim 1, wherein the sensor further comprises a cable, wherein the cable is configured to define a sense loop therethrough when the sensor is coupled to the wearable device.

6. The security device of claim 5, further comprising an alarm module coupled to the cable, wherein the alarm module is configured to generate a security signal in response to interruption of the sense loop.

7. The security device of claim 1, wherein the sensor comprises a groove for receiving a portion of the band therein.

8. The security device of claim 1, wherein the sensor is configured to be coupled to the wearable device across at least a width of the body and the band such that the sensor secures the body to the band.

9. The security device of claim 1, wherein the sensor comprises an engagement member configured to engage the band.

10. The security device of claim 9, wherein the band is configured to receive a pin for inserting through an end of the band and securing the band to the body, and wherein the engagement member is configured to be inserted through the opening to secure the sensor to the body.

11. The security device of claim 10, wherein the sensor comprises an opening configured to receive the end of the band.

12. The security device of claim 11, wherein the pin is configured to secure the end of the band within the opening.

13. The security device of claim 1, further comprising a display stand for removably supporting the wearable device thereon.

14. The security device of claim 13, wherein the wearable device comprises at least one conductor on the interior surface thereof, and wherein the display stand comprises at least one conductor that is configured to engage the at least one conductor to provide power to the wearable device when supported on the display stand.

15. The security device of claim 1, wherein the wearable device comprises a wrist watch.

16. The security device of claim 1, wherein the band comprises an elastic material, and wherein the band is configured to be stretched for engaging the sensor with the body.

17. A method of displaying and protecting a wearable device from theft, the wearable device comprising a body and a band secured thereto, the method comprising:

coupling a sensor to the wearable device between the body and the band such that the sensor is configured to attach the body to the band, the sensor comprising a sensing device; and arming the security device for detecting unauthorized removal of the body from the sensor with the sensing device.

18. A merchandise display security device for displaying and protecting a wearable device from theft, the security device comprising:

a wearable device comprising a body and a band secured thereto; and a sensor configured to be coupled to the wearable device between the body and the band such that the sensor is configured to attach the body to the band, the sensor comprising a cable, wherein the cable is configured to define a sense loop therethrough when the sensor is coupled to the wearable device.

* * * * *